US006712668B2

(12) United States Patent
Lorincz

(10) Patent No.: US 6,712,668 B2
(45) Date of Patent: Mar. 30, 2004

(54) SYSTEM AND METHOD FOR ELECTROPOLISHING NONUNIFORM PIPES

(75) Inventor: Thomas A. Lorincz, Hollister, CA (US)

(73) Assignee: Therma Corporation, Inc., San Jose, CA (US)

( * ) Notice: Subject to any disclaimer, the term of this patent is extended or adjusted under 35 U.S.C. 154(b) by 50 days.

(21) Appl. No.: 09/732,327

(22) Filed: Dec. 6, 2000

(65) Prior Publication Data

US 2002/0068507 A1 Jun. 6, 2002

(51) Int. Cl.[7] ..... B24B 49/00

(52) U.S. Cl. ..... 451/1; 451/6; 451/9; 451/11; 451/908; 204/224 M; 204/225; 204/272; 204/279; 204/208

(58) Field of Search ..... 451/8, 908, 6, 451/9, 11; 204/225, 272, 224 M, 279, 208, 308

(56) References Cited

U.S. PATENT DOCUMENTS

| | | | | |
|---|---|---|---|---|
| 2,764,540 A | | 9/1956 | Farin et al. | 204/140.5 |
| 3,055,812 A | | 9/1962 | Andersson | 204/140.5 |
| 3,202,598 A | | 8/1965 | Covington et al. | 204/224 |
| 3,329,596 A | | 7/1967 | Abt et al. | 204/143 |
| 4,369,101 A | | 1/1983 | Wolff et al. | 204/224 R |
| 4,645,581 A | | 2/1987 | Voggenthaler et al. | 204/275 |
| 4,705,611 A | | 11/1987 | Grimes et al. | 204/129.1 |
| 4,772,367 A | | 9/1988 | Menzel et al. | 204/129.5 |
| 4,826,582 A | | 5/1989 | Lavalerie et al. | 204/196 |
| 5,021,660 A | * | 6/1991 | Tomita et al. | 250/338.3 |
| 5,135,625 A | | 8/1992 | Lewy | 204/129.6 |
| 5,507,923 A | | 4/1996 | Stouse et al. | 205/679 |
| 5,958,195 A | | 9/1999 | Lorincz et al. | 204/224 M |
| 6,217,726 B1 | | 4/2001 | Lorincz et al. | 204/224 M |
| 6,277,264 B1 | | 8/2001 | Lorincz | 205/679 |
| 6,428,681 B1 | * | 8/2002 | Lorincz | 205/645 |

* cited by examiner

*Primary Examiner*—Joseph J. Hail, III
*Assistant Examiner*—Shantese McDonald
(74) *Attorney, Agent, or Firm*—Henneman & Saunders; Larry E. Henneman, Jr.

(57) ABSTRACT

A pipe electropolishing system (10, 10*a*) for in place polishing of a pipe (28) has provision for detecting the instant position of a cathode (14) within the pipe (28) such as cable marks (52) and cable mark sensor (50), an infrared camera (60), heat sensing crayon marks (64), thermisters (66), and capacitance sensors (68), used individually or in combination. According to the inventive in place electropolishing method (80) when it is determined that the cathode is in a nonuniform portion (70) of the pipe (28), then increased polishing action is provided as by increasing the voltage using a variable power supply (30*a*) and/or by slowing down the progress of the cathode (14) using a variable speed cable puller (18).

12 Claims, 3 Drawing Sheets

SYSTEM AND METHOD FOR ELECTROPOLISHING NONUNIFORM PIPES

TECHNICAL FIELD

The present invention relates to the field of electrochemical processing, and more particularly to an apparatus and method for uniformly polishing the interior of pipes which include both uniform portions and nonuniform portions. The predominant current usage of the present inventive improved pipe electropolishing apparatus and method is in the in place polishing of the inner surfaces of pipes.

BACKGROUND ART

It is known in the art to deposit and/or remove materials by passing an electric current through a fluid electrolyte which is in contact with a conductive electrode. Materials are exchanged between the electrolyte and the electrode depending upon the direction of current flow and the ionization of materials to be deposited on or removed from the electrode. Electroplating is a well known application of this general method. Electropolishing is also well known in the art. In the electropolishing process, irregularities and deposits on a surface are removed by causing such to be drawn into the electrolyte solution.

An example is the in place electrochemical polishing of a pipe. In such an example, a cathode is drawn through the pipe while an electrolyte solution is simultaneously piped through the pipe. The pipe acts as an anode and is electrochemically polished in the process. Since the electrolyte solution must be continuously pumped through the pipe during the process, it is most practical to recirculate the solution.

A piping system will generally consist of uniform (e.g., straight, no welds or joints, etc.) sections of pipe and of nonuniform (e.g., bent, welded joint fittings, etc.) sections joining such uniform sections. For various reasons, it happens that the nonuniform portions of pipe tend to become more pitted and uneven during manufacture and in use than do the uniform portions. An alternative in the prior art has been to over polish the uniform sections in order to make certain that the nonuniform portions are sufficiently polished on the interior. However, this alternative is wasteful of time, materials, and energy. The only other alternative has been to polish the interior of the pipes to a lesser degree, leaving the nonuniform portions less than perfectly polished. However, this alternative is much less than desirable, since leaving an uneven surface on the interior of the nonuniform portions continues to cause the same problems which necessitated the polishing in the first place.

It would be advantageous to have an electropolishing system which would adequately polish nonuniform pipe segments without over polishing the uniform segments. However, to the inventor's knowledge, no such system has existed in the prior art. All prior art systems have required either over polishing uniform sections or under polishing nonuniform sections, since there has been no provision for adjusting the amount of polishing in the different sections, as required.

SUMMARY

Accordingly, it is an object of the present invention to provide an apparatus and method for evenly polishing all portions of the interior of a pipe system.

It is still another object of the present invention to provide an apparatus and method for polishing nonuniform portions of a pipe more than uniform sections thereof, such that the end result will be a generally evenly polished finish in all portions of the pipe.

It is yet another object of the present invention to provide an apparatus and method for varying the amount of polishing accomplished in an electropolishing system, depending upon the location of the polishing apparatus.

It is still another object of the present invention to provide an apparatus and method for adapting a pipe electropolishing apparatus such that the amount of polishing accomplished is adapted to specific portions of the pipe. It is yet another object of the present invention to provide a method and apparatus for controlling the amount of polishing accomplished in a pipe electropolishing system according to the amount of polishing required in particular sections of the pipe.

Briefly, a known embodiment of the present invention is an improved in place electropolishing apparatus for polishing a pipe. According to one described embodiment of the present invention, a cathode is drawn through a pipe at a variable rate such that the cathode can be slowed down in nonuniform sections of the pipe, wherein more polishing is required, and further such the cathode can be speeded up in uniform sections of the pipe, wherein less polishing is required. In another described embodiment of the invention, voltage to the cathode is increased while the cathode is in nonuniform portions of the pipe and decreased when the cathode is in uniform portions of the pipe.

According to one embodiment of the present invention, it is desirable to know where within a pipe the electrode is at any given time during the processing process. This can be accomplished in a number of ways, including but not limited to methods and means specifically discussed herein. For example, the cable which pulls the cathode through the pipe could be encoded, for example with colored or magnetic markings or the like, such that the position of the cathode can be generally determined by keeping track of how much cable has been pulled through. Another means would be measure the resistance and/or capacitance between the cathode and a measuring electrode placed at the end of the pipe and/or at various points along the pipe. Other means for detecting the position of the cathode could rely upon the fact that there is a significant amount of heat generated at the location of the cathode during the process. This heat could be detected by an infrared camera, by thermisters placed at specified locations along the pipe, or by marking the pipe at various locations and/or intervals with a heat sensitive crayon that changes color or melts due to heat generated by the electropolishing process.

An advantage of the present invention is that all portions of the interior of the pipe are polished sufficiently to cause such interior surface to be smooth, but not overpolished.

Another advantage of the present invention is that more polishing is accomplished in nonuniform portions of the pipe, where it is needed, than in uniform sections, wherein less polishing action is adequate.

A further advantage of the present invention is that electricity and time are not wasted in polishing uniform sections of the pipe more than is required.

Still another advantage of the present invention is that the polishing process can be speeded up, while still adequately polishing nonuniform portions of the pipe.

Yet another advantage of the present invention is that uniform portions of the pipe are not worn away by unnecessary polishing.

These and other objects and advantages of the present invention will become clear to those skilled in the art in view of the description of modes of carrying out the invention, and the industrial applicability thereof, as described herein and as illustrated in the several figures of the drawings. The objects and advantages listed are not an exhaustive list of all possible objects or advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed objects and/or advantages are not essential elements of the present invention, and should not be construed as limitations.

DETAILED DESCRIPTION

Figures 1, 2:
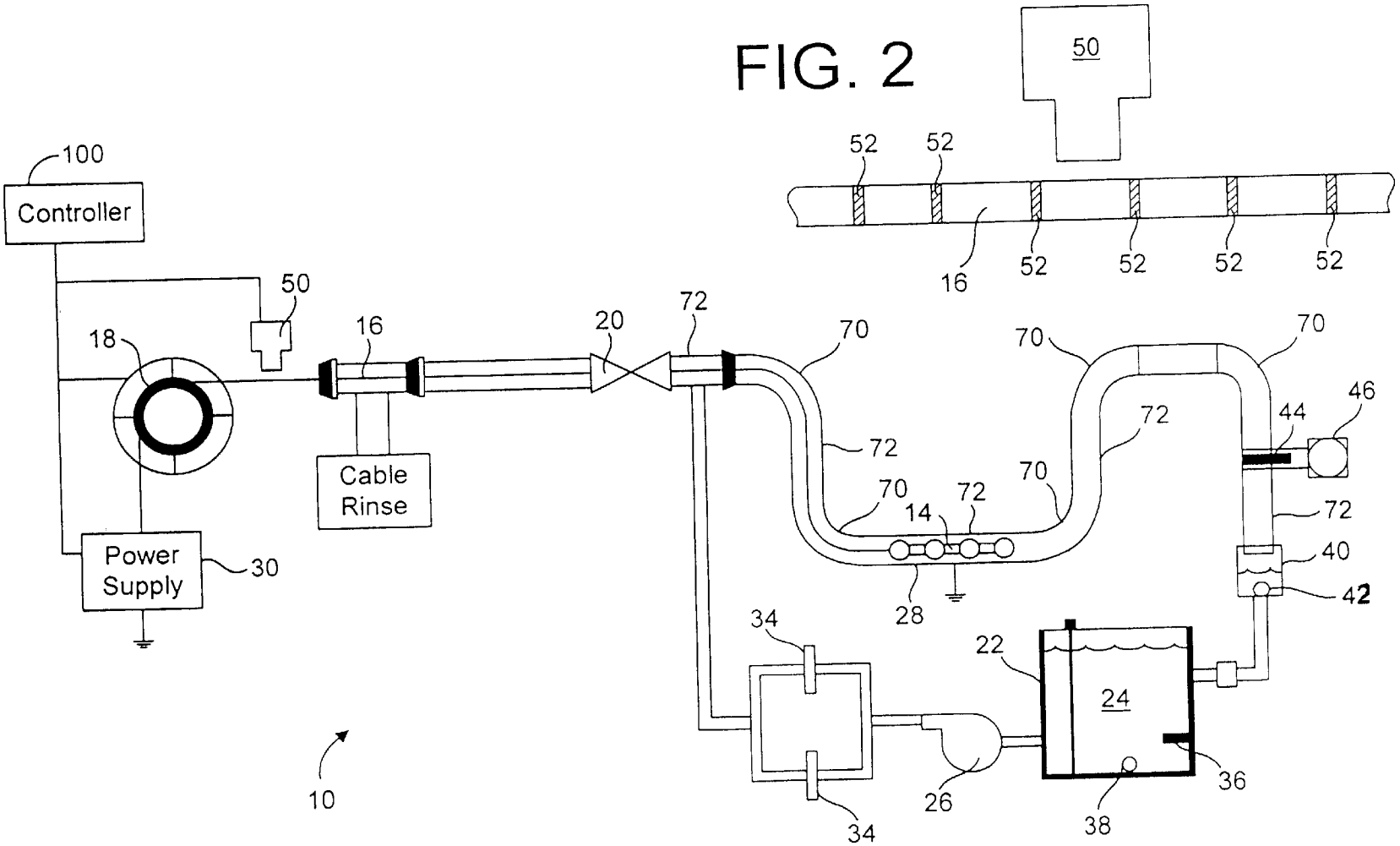
FIG. 1 is block diagrammatic view of an example of an in place pipe electropolishing system.
FIG. 2 is a more detailed view of a portion of the cable and cable mark detector of FIG. 1.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

Unless otherwise stated herein, component parts of the invention will be familiar to one skilled in the art, and may be purchased or readily manufactured accordingly. Also, unless otherwise stated herein, substitutions can be made for the components described, and each of the individual components, except as specifically claimed, is not considered to be an essential element of the invention.

A known mode for carrying out the invention is an in place pipe electrochemical polishing system 10. The in place pipe electrochemical polishing system 10 is depicted in a block schematic diagrammatic view in FIG. 1. As one skilled in the art will recognize, some of the relevant component parts of the in place pipe electrochemical polishing system are a cathode 14, a cathode puller cable 16, a cable puller 18, a valve 20, an electrolyte reservoir 22 for containing a supply of an electrolyte 24, and an electrolyte pump 26, all of which are provided for the purpose of polishing the interior of a pipe 28. In the electrochemical polishing process, the cathode 14 is drawn toward the cable puller 18 by the cathode puller cable 16, while current is applied through the cathode 14 from a power supply 30. The current flows through the electrolyte 24 in the pipe 28, which shares a common ground with the power supply 30 such that the pipe 28 acts as an anode and the interior thereof is polished, according to the known principles of electropolishing. During the process, the electrolyte 24 is generally pumped to flow through the pipe 28 in a direction opposite that in which the cathode 14 is being drawn. The valve 20 prevents the electrolyte 24 from escaping the pipe 28 while allowing the cathode puller cable 16 to be pulled therethrough.

In the particular example of the in place polishing system 10 shown in the view of FIG. 1, two filters 34 are placed in the path of the electrolyte to insure that particulate matter removed from the inside of the pipe 28 is removed from the electrolyte 24 solution as it is recirculated through the in place polishing system 10 by the electrolyte pump 26 and an electric heater 36 and temperature indicating control 38 are provided in the path of the electrolyte 24. In this example, the electric heater 36 and the temperature indicating control 38 are located in the electrolyte reservoir 22. Also, in the present example of the invention, a collector sump 40 catches the electrolyte 24 at it flows out of the pipe 28, and a collector sump pump 42 pumps the electrolyte 24 from the collector sump 40 to the electrolyte reservoir 22. A heat exchanger 44 is provided in the path of the electrolyte 24 with a chiller 46 operatively connected thereto. The chiller 46 is a conventional refrigeration unit and pump, and the heat exchanger 44 is adapted to transfer heat from the electrolyte 24 in the pipe 28 to the chiller 46.

In the embodiment of the invention shown in FIG. 1, the cable puller 18 is a variable speed puller and the cathode puller cable 16 is marked such that a cable mark sensor 50 can sense how far the cable has been pulled. FIG. 2 is a more detailed view of the cable mark sensor 50 and a portion of the cable 16 showing a plurality of cable marks 52 on the cable. In the embodiment shown in the view of FIG. 2, the cable mark sensor 50 is a optical sensor and the cable marks 52 are relatively (as compared to the color of the cable 16) dark bands about the cable 16. However, it is within the scope of the sensor that essentially any means, known or yet to be developed, could be used to sense how much of the cable has been pulled past the cable mark sensor 50. For example, the cable marks 52 could be magnetic bands and the cable mark sensor 50 could be a magnetic sensor.

Figure 3:
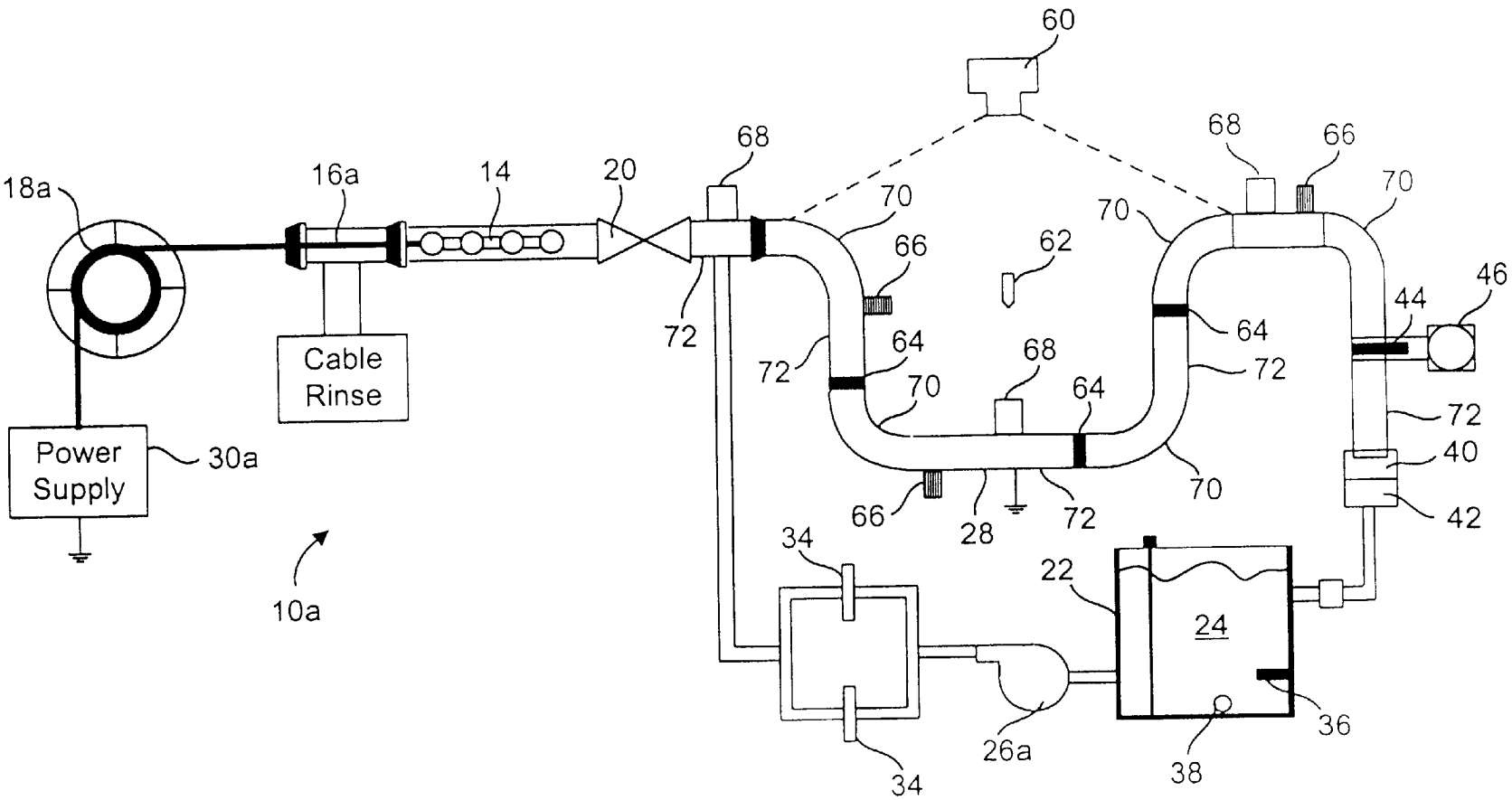
FIG. 3 is a block diagrammatic view of an example of an alternative in place pipe electropolishing system.

FIG. 3 is an alternative in place polishing system 10*a*, in which components are alike to and numbered the same as those of the example of FIG. 1, except for those specifically discussed herein as being different. In the alternative in place polishing system 10*a*, a standard cable 16*a* is a plain, unmarked cable, such as has been used in the prior art. A standard cable puller 18*a* is a conventional cable puller such as has been used in the prior art. Although the standard cable puller 18*a* is adjustable such that it can pull the cable 16*a* at different speeds, according to one embodiment of the present inventive method which will be discussed hereinafter, it is anticipated that the cable 16*a* will be pulled at essentially the same speed through the entire pipe 28 when the alternative pipe electrochemical polishing system 10*a* is used. However, in the alternative in place polishing system 10*a*, an alternative power supply 30*a* is variable such that the voltage applied to the cathode 14 can be varied.

Also visible in the view of FIG. 3 are an infra red camera 60, a heat sensing crayon 62 and a plurality (three are shown) of heat sensing crayon marks 64 on the pipe 28. A plurality (three are shown) of thermisters 66 are also shown placed on the pipe 28 in the view of FIG. 3. A plurality (three are shown) of capacitive sensors are also shown on the pipe 28 in the view of FIG. 3.

As was briefly discussed hereinbefore, the practice of the present invention requires some knowledge of the present location of the cathode 14 during the polishing process. Since the cathode 14 gives off a substantial amount of heat during the electropolishing process, the infra red camera 60 can be used to detect the instant location of the cathode 14. Similarly, the heat sensing marks 64 made by the heat sensing crayon 62 will change color when the cathode 14 is passing within the pipe 18 under the marks 64, thereby disclosing the location of the cathode 14. In like manner, the thermisters 66 will detect a rise in heat when the cathode 14 is passing within the pipe 28 at the location of the thermisters 66. Also, when the cathode 14 passes through a particular location in the pipe 28, the capacitance across the pipe will be reduced, and this can be detected by one of the capacitance sensors 68 placed at such location.

It should be noted that, in actual practice, more than three of the thermisters 66, capacitance sensors 68, heat sensing crayon marks 64, or the like will be used. For example, each transition between a uniform portion 72 and a nonuniform portion 70 of pipe 28 would generally be delimited by one such sensor. In some applications it might also be desirable to place such a device on one or more uniform sections 72 of the pipe. If used, the infrared camera 60 could be moved, as necessary during the course of the polishing process, such that those portions of the pipe 28 wherein the cathode 14 is currently located could be seen by the infra red camera 60. It should be noted that the practice of the present inventive method is not limited to the use of any one method for detecting the position of the cathode 14. Any of the thermisters 66, capacitance sensors 68, heat sensing crayon marks 64, or infrared camera 60, or any combination thereof could be used to detect the current position of the cathode 14 during a single electropolishing process. Also, any of these could be used in combination with the cable marks 52 and cable mark sensor 50, previously discussed herein in relation to FIGS. 1 and 2, or could be substituted for or used in combination with other methods and/or means for detecting the present position of the cathode 14.

Figure 4:
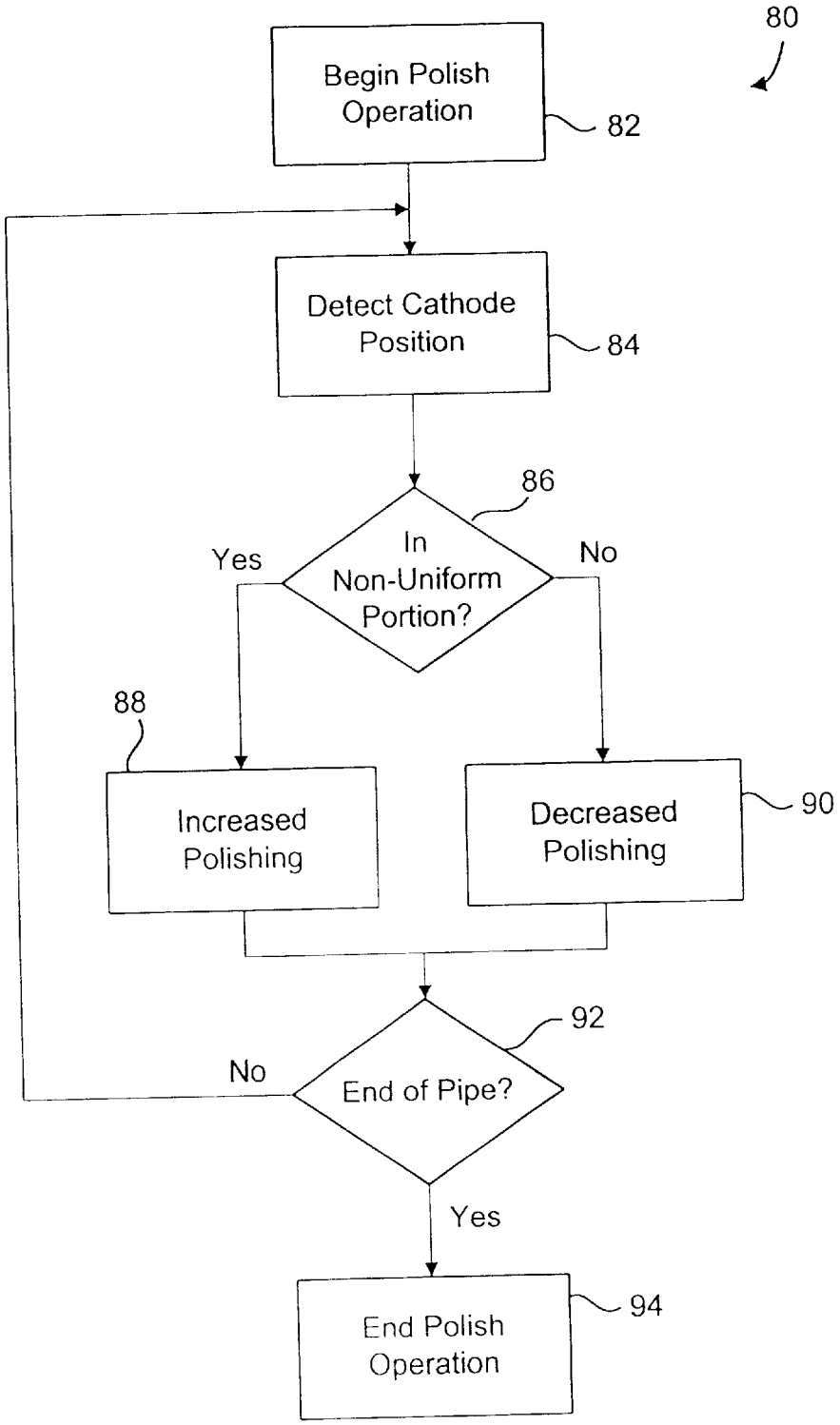
FIG. 4 is a flow diagram depicting an example of the present inventive method.

FIG. 4 is a flow diagram depicting relevant operations of an example of the inventive portion of the in place electropolishing method 80. In a begin polish operation 82 voltage is applied to the cathode 14 by the power supply 30 (FIG. 1) or 30*a* (FIG. 3), and the cable puller 18 (FIG. 1) or cable puller 18*a* (FIG. 3) begins to pull the cathode 14 through the pipe 28 by the cathode puller cable 16 (FIG. 1) or 16*a* (FIG. 3). The begin polish operation 82 is conventional in nature and is not unlike such operation as applied in the prior art.

One skilled in the art will recognize in the diagram of FIG. 4 that a detect cathode position operation 84 begins an operational loop that is repeated during the continuation of the in place electropolishing method 80. In a detect cathode position operation 84, the position of the cathode 14 (FIGS. 1 and 3) is detected, such as by use of the calibrated cathode puller cable 16 having thereon cable marks 52 and the cable marks sensor as discussed in FIG. 1. Alternatively, any other method, such as the heat detecting methods using the infra red camera 60 (FIG. 3), the heat sensing crayon marks 64, the thermisters, or the like and/or any combination thereof could be used. Another alternative for accomplishing the detect cathode position operation 84 could be the use of the capacitance sensors 68 as discussed previously herein in relation to FIG. 3, or essentially any other means for detecting the position of the cathode 14, now known or yet to be developed.

In an in nonuniform portion decision operation, it is determined if the cathode 14 is presently working in a nonuniform portion 70 of the pipe 28 as compared to a uniform portion 72. If the cathode 14 is in a nonuniform portion 70 the in place electropolishing method 80 proceeds to an increased polishing operation 88. If the cathode 14 is in a uniform portion 72 then the in place electropolishing method 80 proceeds to a decreased polishing operation 90. In the decreased polishing operation 90 the process is much like that of the prior art. The cathode 14 is drawn through the pipe 28 at a rate of approximately three inches per minute, and the voltage applied to the cathode will be calculated according to the variables of the application according to the prior art. Alternatively, in the increased polishing operation 88 more polishing action is provided for the nonuniform portions 70 of the pipe 28. Such increased polishing actions can be provided by slowing down the rate of progress of the cathode 14 through the pipe 28. For example, the rate can be slowed to approximately one and one half inches per minute using the variable speed cable puller 18 (FIG. 1). Alternatively, the polishing action can be increased by increasing the voltage to the cathode 14 using the variable power supply 30*a* (FIG. 3). It is within the scope of the invention that the increased polishing operation 88 could also be accomplished by some combination of slowing the progress of the cathode 14 and increasing the voltage applied thereto.

Following either the increased polishing operation 88 or the decreased polishing operation 90, in an end of pipe decision operation 92 it is determined if the cathode 14 has reached the end of the pipe 28. If the cathode 14 has reached the end of the pipe 28, the in place electropolishing method 80 proceeds to an end polish operation 94 wherein the pipe electrochemical polishing system 10, 10*a* is cleaned and shut down according to prior art methods. If it is determined in the end of pipe decision operation 92 that the end of the pipe 28 has not been reached then the decision loop returns to the detect cathode position operation 84 and the process is repeated as indicated in the flow diagram of FIG. 4.

Each of the described embodiments relies on varying degrees of operator participation in the electropolishing process. It is possible, however, to more fully automate the electropolishing process of the present invention. For example, a controller 100 (FIG. 1) can be coupled to receive input from cable mark sensor 50 and to provide control signals to cable puller 18 and/or power supply 30 to implement the electropolishing processes of the present invention which are stored in a computer readable medium (not shown) of controller 100. The operator would then only need to input the contour of pipe 28 to controller 100. In a particular embodiment, controller 100 is a desktop or laptop computer system.

Various other modifications to the inventive method and apparatus are also quite possible, while remaining within the scope of the invention. For example, alternative means could be developed for determining the position of the cathode 14. Also, alternative means for increasing the polishing action within nonuniform portions 70 of the pipe 28 could be developed. Another logical alternative would be to use the apparatus specifically disclosed herein, and/or other apparatus yet to be developed, in combinations not specifically discussed herein.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive pipe electrochemical polishing system 10, 10*a* and associated in place electropolishing method 80 are intended to be widely used for the in place polishing of the interior of piping systems. Since the inventive pipe electrochemical polishing system 10, 10*a* and associated in place electropolishing method 80 may be readily produced and integrated with existing electropolishing systems, and since the advantages as described herein are provided, it is expected that it will be readily accepted in the industry. For these and other reasons, it is expected that the utility and industrial applicability of the invention will be both significant in scope and long-lasting in duration.

What is claimed is:

1. An electropolishing apparatus for polishing the interior of a pipe having both nonuniform portions and uniform portions, the electropolishing apparatus comprising:

an electrical element;

a power supply for providing power to said electrical element;

a puller for pulling said electrical element through the pipe; and a position detector for detecting the position of said electrical element; wherein polishing action in the nonuniform portions is increased as compared to the polishing action in the uniform portions by increasing the voltage supplied by said power supply to said electrical element, as compared to voltage supplied when said electrical element is in the uniform portions.

2. The electropolishing apparatus of claim 1, wherein:

the polishing action is increased in the nonuniform portions by slowing the rate at which said puller pulls said electrical element through the nonuniform portions as compared to the rate at which said puller pulls said electrical element through the uniform portions.

3. The electropolishing apparatus of claim 1, wherein:

said position detector includes a detector for detecting how much of a cable has been pulled through the pipe by the puller.

4. The electropolishing apparatus of claim 3, wherein:

said position detector includes a plurality of marks on the cable and a mark detector.

5. The electropolishing apparatus of claim 4, wherein:

the mark detector is a optical mark detector.

6. The electropolishing apparatus of claim 4, wherein:

the mark detector is a magnetic mark detector.

7. The electropolishing apparatus of claim 1, wherein:

said position detector includes a heat detector for detecting heat created by said polishing action.

8. The electropolishing apparatus of claim 7, wherein:

said position detector includes an infra red camera.

9. The electropolishing apparatus of claim 7, wherein:

said position detector includes a thermister.

10. The electropolishing apparatus of claim 1, wherein:

said electrical element is a cathode.

11. An electropolishing apparatus for polishing the interior of a pipe having both nonuniform portions and uniform portions, the electropolishing apparatus comprising:

an electrical element;

a power supply for providing power to said electrical element;

a puller for pulling said electrical element through the pipe; and a position detector for detecting the position of said electrical element, said position detector including a heat detector for detecting heat created by said polishing action; wherein said position detector includes a heat sensing crayon mark, and polishing action in the nonuniform portions is increased as compared to the polishing action in the uniform portions.

12. An electropolishing apparatus for polishing the interior of a pipe having both nonuniform portions and uniform portions, the electropolishing apparatus comprising:

an electrical element;

a power supply for providing power to said electrical element;

a puller for pulling said electrical element through the pipe; and a position detector for detecting the position of said electrical element; wherein said position detector includes a capacitance measuring device for measuring the capacitance in the pipe, and polishing action in the nonuniform portions is increased as compared to the polishing action in the uniform portions.

* * * * *